US005348448A

United States Patent [19]

Ikemoto et al.

[11] Patent Number: 5,348,448

[45] Date of Patent: Sep. 20, 1994

[54] FLUID ROTATING APPARATUS WITH PLURAL DRIVE MOTOR SYNCHRONIZATION SYSTEM

[75] Inventors: Yoshihiro Ikemoto, Katano; Teruo Maruyama, Hirakata, both of Japan

[73] Assignee: Matsushita Electric Industrial Co., Ltd., Osaka, Japan

[21] Appl. No.: 33,755

[22] Filed: Mar. 18, 1993

[30] Foreign Application Priority Data

Mar. 19, 1992 [JP] Japan ..... 4-062989

[51] Int. Cl.[5] ..... F04B 49/00; H02P 5/46

[52] U.S. Cl. ..... 417/17; 417/42; 417/44 J; 417/53; 417/203; 417/423.4; 318/85

[58] Field of Search ..... 417/203, 16, 17, 42, 417/44 R, 44 J, 53, 423.4, 420; 318/73, 74, 76, 85

[56] References Cited

U.S. PATENT DOCUMENTS

| | | | |
|---|---|---|---|
| 4,617,498 | 10/1986 | Ruppert | 318/85 |
| 4,808,077 | 2/1989 | Kan et al. | 417/45 |
| 5,197,861 | 3/1993 | Maruyama et al. | 417/42 |

FOREIGN PATENT DOCUMENTS

| | | | |
|---|---|---|---|
| 221003 | 9/1986 | European Pat. Off. . | |
| 82266 | 5/1983 | Japan | 318/65 |
| 103889 | 6/1983 | Japan | 318/85 |
| 195481 | 8/1987 | Japan | 417/42 |
| 155089 | 6/1989 | Japan | 418/2 |
| 200084 | 8/1989 | Japan | 418/2 |
| 3043689 | 2/1991 | Japan | 417/17 |
| 1179516 | 9/1985 | U.S.S.R. | 318/65 |

*Primary Examiner*—Richard A. Bertsch
*Assistant Examiner*—Roland G. McAndrews, Jr.
*Attorney, Agent, or Firm*—Wenderoth, Lind & Ponack

[57] ABSTRACT

A fluid rotating apparatus includes non-circular rotors accommodated in a housing, rotary shafts having the rotors, bearings for rotatably supporting the shafts, a fluid suction and a fluid discharge ports formed in the housing, a positive displacement pump section formed of combination of the housing and rotors, and gears connected with the shafts having backlash set smaller than backlash between the rotors. The apparatus includes motors for independently driving the shafts, a device for detecting a rotating angle or speed of rotation of the motors, a unit for controlling the motors to synchronously rotate, a unit for detecting a current running in the motors, a unit for detecting a relative position of the shafts, and a rotation commanding unit, to which outputs from the motor current detecting unit and relative position detecting unit are inputted, for deciding whether or not a shift amount of the synchronous rotation is larger than a specified value based on the outputs of the motor current detecting unit and/or the relative position detecting unit, and outputting to the motor controlling unit a signal to decelerate one shaft when the rotation command unit decides that the shift amount of the synchronous rotation is larger than the value.

13 Claims, 8 Drawing Sheets

Fig. 3
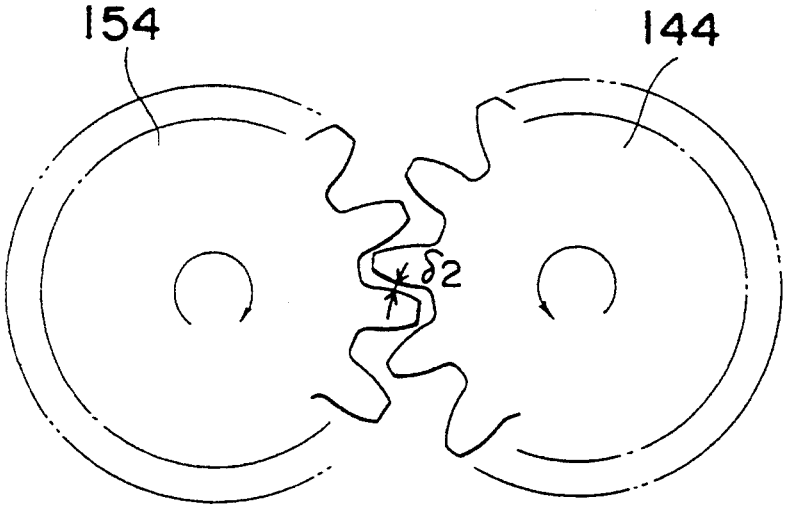
Fig. 12 - PRIOR ART
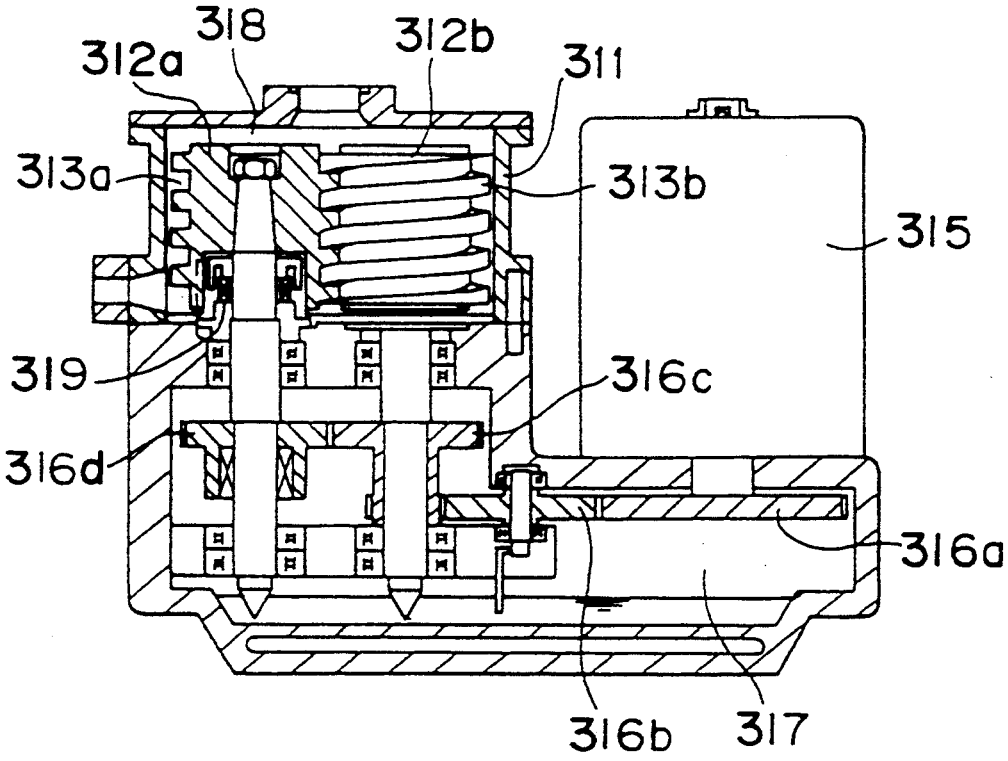

FLUID ROTATING APPARATUS WITH PLURAL DRIVE MOTOR SYNCHRONIZATION SYSTEM

BACKGROUND OF THE INVENTION

The present invention generally relates to a fluid rotating apparatus, and more particularly to a fluid rotating apparatus, such as a positive displacement vacuum pump used in the semiconductor manufacturing facilities to vacuumize a chamber, in the structure to synchronously rotate a plurality of rotary shafts rotating at high speeds.

A CVD device, a dry etching device, a sputtering device, a vapor deposition device, etc. used in the manufacturing process of semiconductors requires a vacuum pump to produce a vacuum environment. A vacuum pump is also used when magnetic discs, liquid crystals, and the like are manufactured.

In a positive displacement vacuum pump, two rotors are synchronously rotated while the screws provided in the outer peripheries of the rotors are meshed with each other. At this time, as the volume of a space formed between the two screws is changed, this change of the volume is utilized to suck and compress gas thereby to vacuumize the chamber.

An example of the aforementioned screw type vacuum pump is illustrated in FIG. 12. There are provided two rotors in a housing 311, having the respective rotary center shafts set parallel to each other. Screws are formed in the outer peripheries of the rotors 312*a*, 312*b*. As recessed parts (grooves) 313*a* of the screw of one rotor are meshed with projecting parts 313*b* of the other rotor, a space is defined between the two rotors. Therefore, when the rotors 312*a*, 312*b* rotate, the volume of the space is changed, thereby achieving suction/discharge of the air.

The drawbacks of the above screw type vacuum pump will be discussed now.

In the positive displacement vacuum pump shown in FIG. 12, the rotors 312*a*, 312*b* are synchronously rotated by the action of timing gears. More specifically, the rotation of a motor 315 is transmitted from a driving gear 316*a* to an intermediate gear 316*b* and further to one of timing gears 316*c*, 316*d* which are provided in the shafts of the rotors 312*a*, 312*b* and meshed with each other. The phase of the rotating angle of each rotor 312*a*, 312*b* is adjusted through the engagement of the timing gears 316*c*, 316*d*. That is, both the transmission of power from the motor and the synchronous rotation of the rotors are realized by means of gears in the vacuum pump of this screw type, and therefore a lubricating oil filled in a mechanical operating chamber 317 housing the gears should be supplied to the gears. Moreover, a mechanical seal 319 is provided between the mechanical operating chamber 317 and a fluid operating chamber 318 where the rotors are accommodated so as to prevent invasion of the lubricating oil.

As depicted hereinabove, the screw type vacuum pump with two rotors are inconvenient in the following points:

(1) Many gears are required for the transmission of power and the synchronous rotation of rotors, thus increasing the number of components and making the apparatus complicate in structure;

(2) The contact-type synchronous rotation of rotors using gears is unable to operate at high speeds and is bulky;

(3) A mechanical seal should be regularly exchanged with a fresh one subsequent abrasion, and is not completely maintenance-free;

(4) The large sliding torque due to the mechanical seal increases the mechanical loss.

SUMMARY OF THE INVENTION

The inventors of the present invention have already proposed a positive displacement vacuum pump provided with a plurality of rotors driven by a plurality of independent motors. The rotors are controlled to synchronously rotate in a contactless fashion by means of a detecting means, e.g., a rotary encoder which detects the rotating angle and the rotating speed of the rotors.

Accordingly, the rotors can rotate at high speeds, and the vacuum pump becomes maintenance-free and easy to be kept clean and miniaturized.

The present invention is a further improvement of the above proposal, whereby the shift of the synchronous rotation of a plurality of rotary shafts during the rotation is detected thereby to prevent the damage or breakage of the plurality of rotary shafts by decelerating the rotary shafts.

In accomplishing these and other objects, according to one aspect of the present invention, there is provided a fluid rotating apparatus provided with a plurality of non-circular rotors accommodated in a housing, a plurality of rotary shafts having the rotors, bearings for supporting rotation of the plurality of rotary shafts, a fluid suction port and a fluid discharge port formed in the housing, a positive displacement pump section formed of combination of the housing and the plurality of rotors, and a plurality of gears connected with the rotary shafts having a backlash set smaller than a backlash between the plurality of rotors, the fluid rotating apparatus characterized by further comprising:

motors for independently driving the plurality of rotary shafts;

a rotation detecting means for detecting one of a rotating angle and speed of rotation of the motors;

a motor controlling unit for controlling the motors to synchronously rotate;

a motor current detecting unit for detecting a current running in the motors;

a relative position detecting unit for detecting a relative position of the plurality of rotary shafts; and a rotation commanding unit, to which outputs from the motor current detecting unit and the relative position detecting unit are inputted, for deciding whether or not a shift amount of the synchronous rotation of the plurality of rotary shafts is larger than a specified value based on the outputs of the motor current detecting unit and/or the relative position detecting unit, and outputting to the motor controlling unit a signal to decelerate one of the plurality of rotary shafts when the rotation command unit decides that the shift amount of the synchronous rotation of the plurality of rotary shafts is larger than the specified value.

According to the present invention, not only each of a plurality of rotary shafts is driven by an independent motor, but the rotary shafts are synchronously controlled and rotated by a non-contacting type rotation synchronizing means, thereby dispensing with many gears for the synchronous rotation of the rotary shafts and the transmission of power, and consequently requiring no lubricating oil for the gears. The vacuum pump of the present invention is able to rotate at high speeds and compact in size, with necessities for maintenance work reduced.

Further, according to the present invention, the shift during the synchronous rotation of a plurality of rotary shafts is detected by a motor current detecting unit and/or a relative position detecting unit which detects the relative position of the plurality of rotary shafts, and decided by a rotation commanding unit. Then, the plurality of rotary shafts are decelerated to be prevented from being damaged or broken through mechanical collision.

In the case where the sudden shift of the synchronous rotation results from the breakage of bearings, the contact between the rotors and housing, or the change of the load of the rotary shafts, etc., the supply of a current to the motors is stopped to decelerate the plurality of rotary shafts while the gears are held engaged with each other. Therefore, a great amount of damage or breakage of the rotary shafts can be avoided and the burning or demagnetization of the motors is also prevented.

If the synchronous rotation is shifted minutely rather than suddenly, a current is continuously applied at least to one motor, thereby decreasing the motor current gradually. The other rotary shafts press the rotary shaft without the supply of current via the meshed gears thereby to decelerate or stop the rotary shaft. Accordingly, the rotary shafts can be prevented from being damaged or broken.

When a plurality of non-circular rotors are formed in the shape of screws, the flow of a fluid is approximately continuous, with influences of the internal leak reduced. Moreover, the internal space of the rotors is increased and utilized as a space to accommodate the bearings, motors or the like. The apparatus is thus constructed compact.

BRIEF DESCRIPTION OF THE DRAWINGS

These and other objects and features of the present invention will become clear from the following description taken in conjunction with the preferred embodiment thereof with reference to the accompanying drawings, in which:

FIG. 3 is a diagram of contact preventing gears of the first embodiment;

FIG. 12 is a sectional plan view of a conventional screw type vacuum pump.

DETAILED DESCRIPTION OF THE PREFERRED EMBODIMENTS

Figure 1:
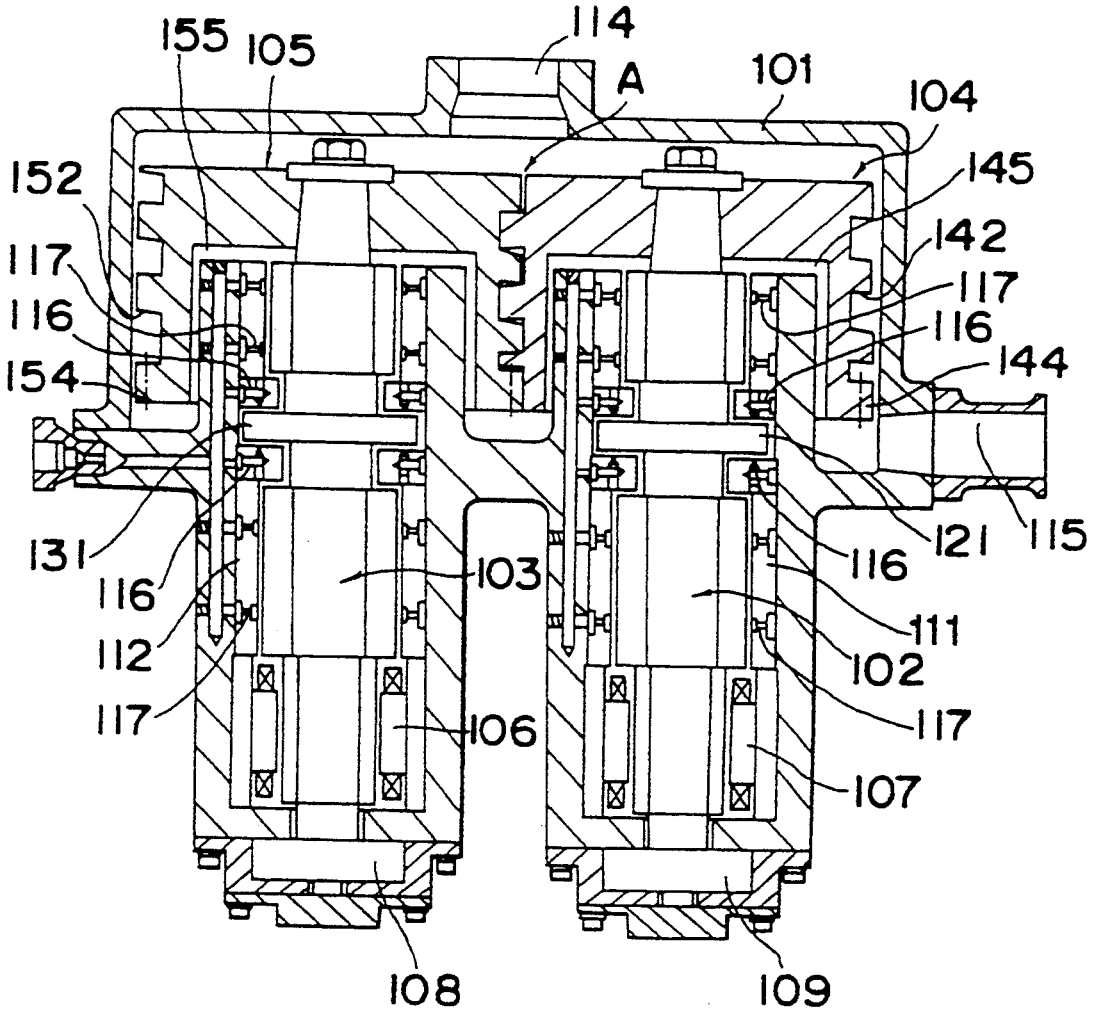
FIG. 1 is a cross sectional view of a positive displacement vacuum pump according to a first embodiment of the present invention.

Before the description of the present invention proceeds, it is to be noted that like parts are designated by like reference numerals throughout the accompanying drawings.

Figure 2:
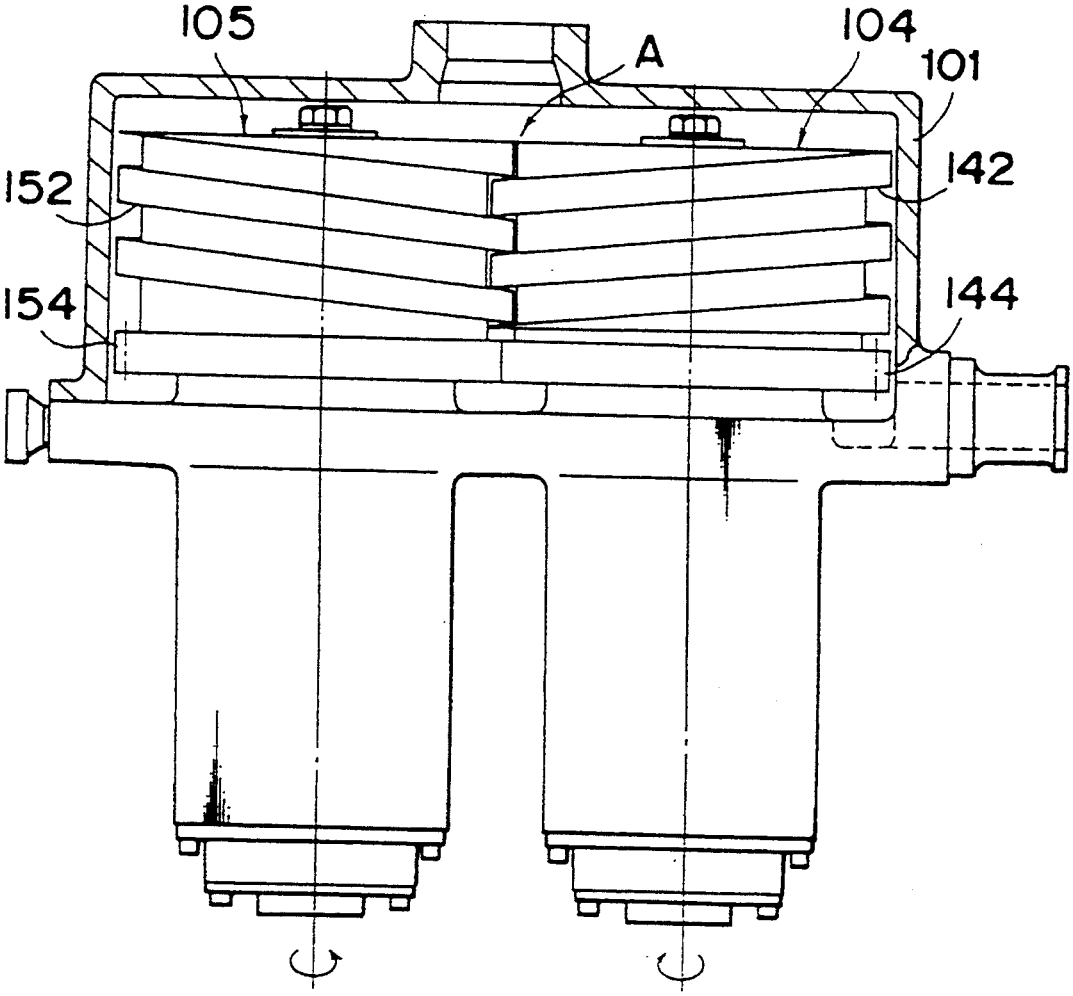
FIG. 2 is a sectional side view of the first embodiment with a housing partly cut.

FIGS. 1 and 2 show a positive displacement vacuum pump in a fluid rotating apparatus of one preferred embodiment of the present invention. FIG. 1 is a cross sectional view of the pump and FIG. 2 is a sectional side view with a housing alone cut.

In a housing 101 of the vacuum pump, there are provided a first bearing chamber 111 accommodating a first rotary shaft (driving shaft) 102 in the vertical direction, and a second bearing chamber 112 accommodating a second rotary shaft (driving shaft) 103 in the vertical direction. Cylindrical rotors 104, 105 are fitted from outside at the upper ends of the corresponding rotary shafts 102, 103. Thread screws 142, 152 are formed to be meshed with each other in the outer peripheries of the rotors 104, 105. The section where the screws 142, 152 are meshed with each other forms a positive displacement vacuum pump structural part (A). That is, the rotation of the rotary shafts 102, 103 accompanies the periodic change of volume of a space defined by the recessed parts (threads) and projecting parts of the screws 142, 152 and the housing 101, thus realizing suction/discharge of the air.

Contact preventing gears 144, 154 as shown in FIGS. 2 and 3 are provided in the outer peripheries of the rotors 104, 105 at the lower ends thereof so as to prevent the contact between the screws. A solid lubricating film is formed in each of the contact preventing gears 144, 154 to endure a slight contact of metals as well. A backlash 62 between the contact preventing gears 144 and 154 is set smaller than a backlash between the screws in the outer peripheries of the rotors 104 and 105. Therefore, the contact preventing gears 144, 154 never come in touch with each other when the rotary shafts 102, 103 are smoothly rotated synchronously, but are brought in touch with each other prior to the contact of the screws 142, 152 if the synchronous rotation is missed. Accordingly, the screws 142, 152 are prevented from colliding into touch with each other. It is feared that the parts cannot be accurately manufactured at the practical level if the backlashes should be minute. However, since the leaking sum of the fluid in one cycle of the pump is proportional to the time required for one cycle of the pump, it is possible for the vacuum pump to maintain sufficient performance (ultimate vacuum degree or the like) even when the backlash between the screws 142 and 152 is made slightly larger so long as the rotary shafts 102, 103 rotate at high speeds. Therefore, if the rotary shafts are designed to rotate at high speeds, the backlashes of the necessary size to prevent the collision of the screws 142 and 152 can be fully secured with the general processing accuracy.

A suction port 114 is opened at the upstream side of the positive displacement vacuum pump structural part (A) of the housing 101. A discharge port 115 is provided at the downstream side thereof. The first and second rotary shafts 102, 103 are supported by contactless hydrostatic pressure bearings provided in the internal spaces 145, 155 of the cylindrical rotors 104, 105, respectively. More specifically, when a compressed gas is supplied to the upper and lower surfaces of disc-like parts 121, 131 of the rotary shafts 102, 103 through orifices 116, thrust bearings are constituted. On the other hand, when a compressed gas is supplied to the outer peripheral surfaces of the rotary shafts 102, 103 through orifices 117, radial bearings are constituted. If the compressed gas is clean nitrogen gas generally used in the semiconductor facilities, etc., the pressure inside the internal spaces 145, 155 accommodating the motors can be raised higher than atmospheric pressure, thus preventing a corrosive reactive gas from forming deposits in the internal spaces 145, 155.

The bearings may not be hydrostatic pressure bearings, but may be magnetic bearings. In the case of the magnetic bearings or the like, the high speed rotation of the rotors can be easily achieved and an oil-free construction can be obtained because of the contactless rotation. In the case where a ball bearing is used and lubricating oil is supplied to the ball bearing, it is possible to prevent the penetration of the lubricating oil into the fluid operating chamber by a gas purge mechanism utilizing the nitrogen gas.

Both the first rotary shaft 102 and the second rotary shaft 103 are rotated as high as at several tens of thousand rpm by AC servo motors 106, 107 independently provided in the lower parts thereof. An incremental encoder 108 and an absolute encoder 109 are mounted to the rotary shafts 103, 102 as rotation detecting means.

Figure 4:
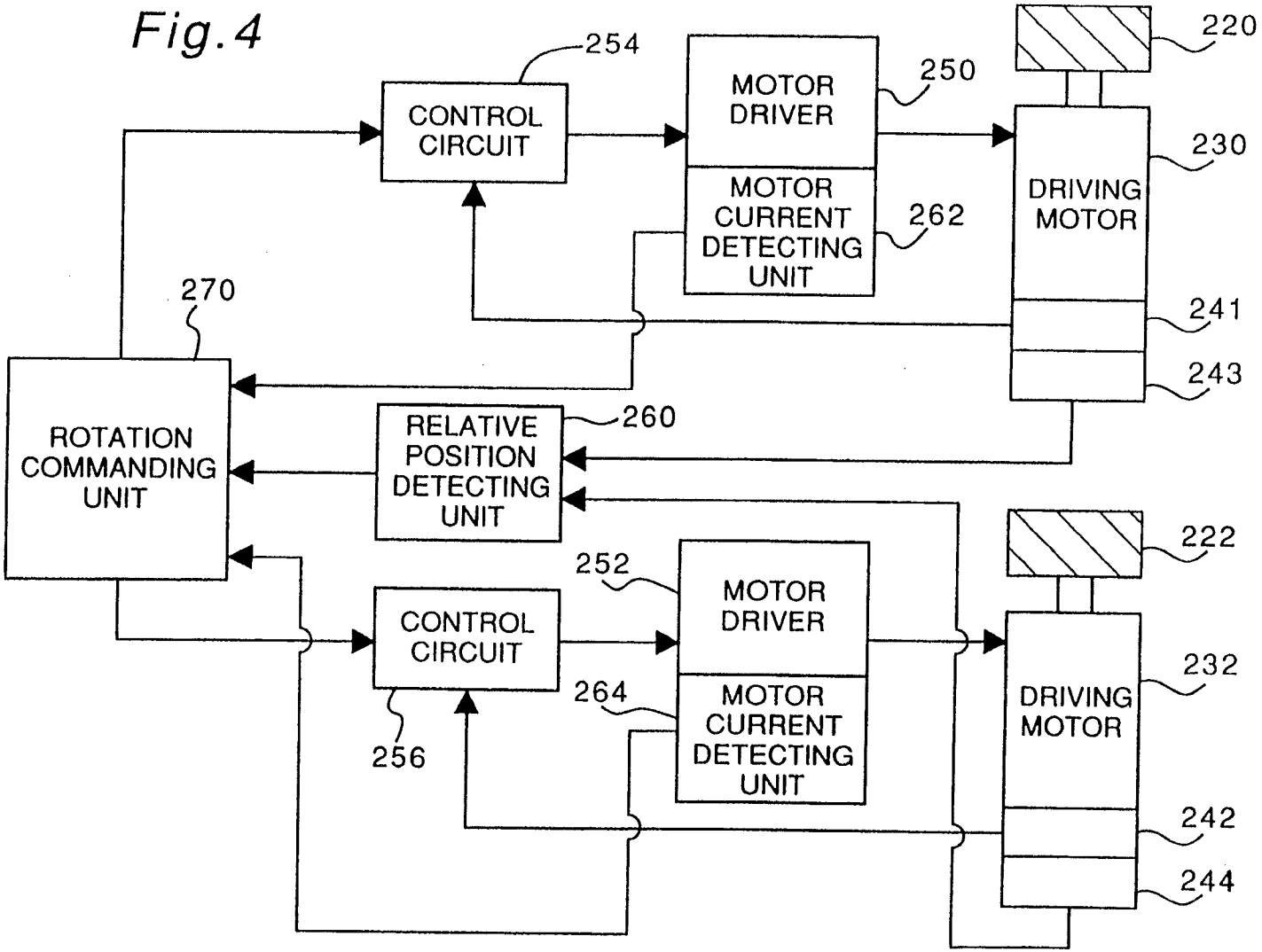
FIG. 4 is a block diagram of a circuit driving the positive displacement vacuum pump of the first embodiment.

FIG. 4 is a block diagram of a circuit for driving the vacuum pump of the present invention. Rotor screws are provided as loads to rotary shafts 220, 222 (103, 102) of a pair of driving motors 230, 232 which are AC servo motors. The driving motors 230, 232 have incremental encoders 241, 242 and absolute encoders 243, 244, respectively. The incremental encoders 241, 242 detect the rotating speed, namely, the speed of rotation of the driving motors 230, 232, while the absolute encoders 243, 244 detect the rotating position, i.e., phase or amount of the angular displacement of the driving motors 230, 232. The driving motors 230, 232 are connected to control circuits 254, 256 via motor drivers 250, 252. A rotation commanding unit 270 is connected to the control circuits 254, 256 to order the rotation of the motors. Detecting units 262, 264 detect current values of the driving motors 230, 232, and a detecting unit 260 calculates and detects the relative position of the rotary shafts 220, 222 based on the data of the absolute encoders 243, 244. The outputs of the motor current detecting units 262, 264 and the relative position detecting unit 260 are input to the rotation commanding unit 270.

Figure 5:
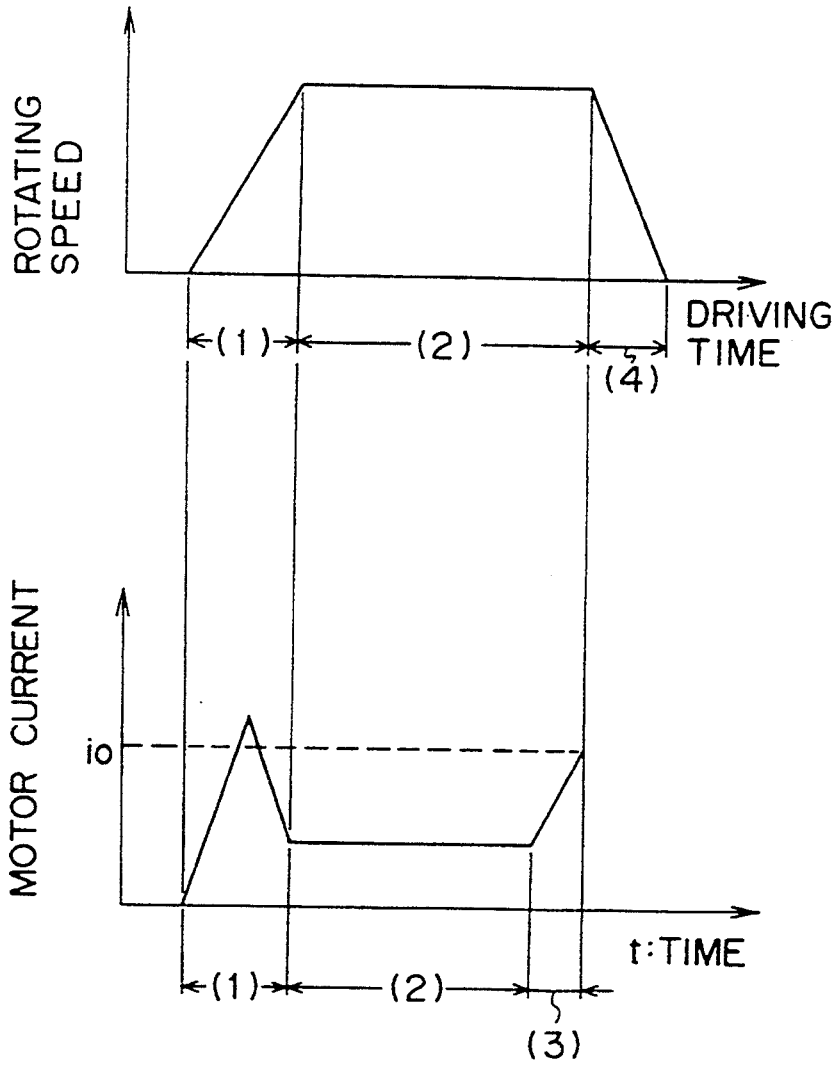
FIG. 5 is a characteristic curve diagram of the relationship between the driving time and the rotating speed of a rotary shaft, and the relationship between a motor current and the time in a positive displacement vacuum pump of a further embodiment of the present invention.
Figure 6:
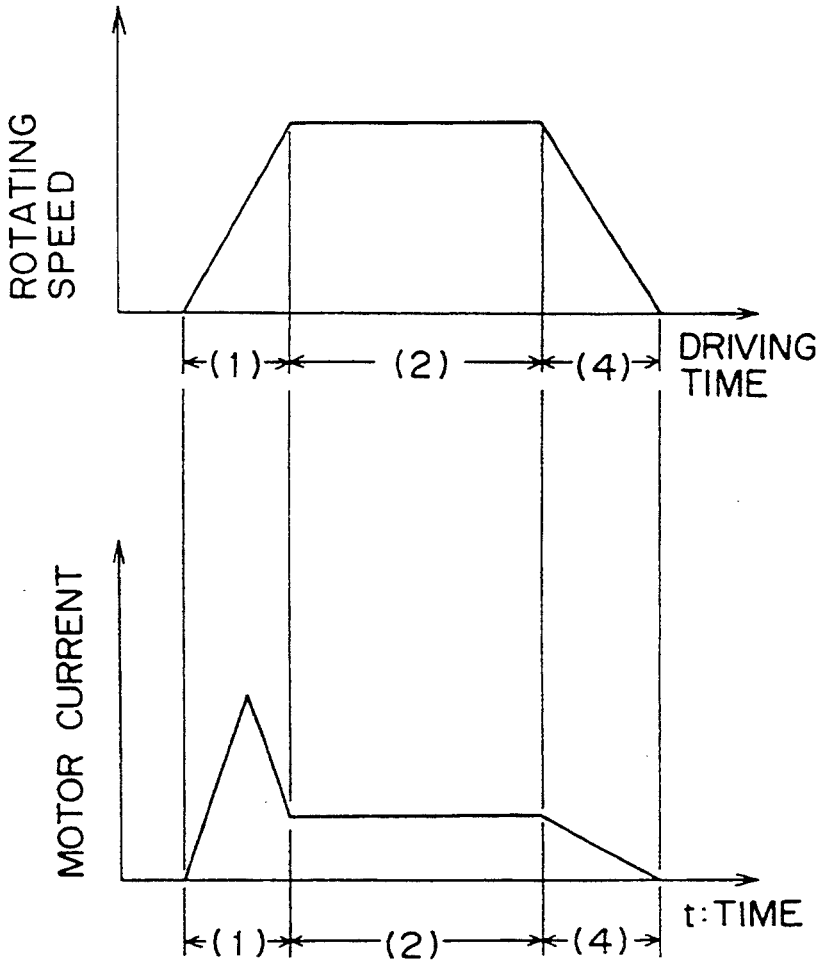
FIG. 6 is a characteristic curve diagram of the relationship between the driving time and the rotating speed of a rotary shaft, and the relationship between a motor current and the time in a positive displacement vacuum pump of a still further embodiment of the present invention.

The operation of the vacuum pump of the embodiment will be depicted with reference to FIGS. 4–6. In FIGS. 5 and 6, the rotary shafts 102, 103 (220, 222) of the vacuum pump which were in a stop state start to accelerate to a preset rotating speed in the section (1). At this time, a large current flows in the motors to activate the rotary shafts. In the section (2), the vacuum pump operates at the preset rotating speed, with sucking the air through the suction port 114 and discharging through the discharge port 115. The motors rotate with a predetermined rotating speed, generating the power to withstand the loss of load such as the bearing loss, windage loss, iron loss, copper loss, and the load to suck, compress, and discharge the air. The motor current is generally smaller than the current value generated in the section (1).

In order to synchronously rotate the rotary shafts 220, 222 (102, 103) in a contactless manner with a predetermined rotating speed, signals of the incremental encoders 241, 242 are fed back to the control circuits 254, 256, and the signal from the rotation commanding unit 270 is subjected to pulse conversion, so that the rotating frequency is controlled in accordance with the PLL (Phase Locked Loop) method. At the same time, the outputs of the absolute encoders 243, 244 are sent to the relative position detecting unit 260 to detect the shift of the synchronous rotation of the rotary shafts 220, 222 (102, 103). When the shifting amount is smaller than a set value (smaller than the backlash $\delta 2$), a shift correction signal is sent to each control circuit 254, 256 from the rotation commanding unit 270. The control circuits 254, 256 in turn form correcting pulses for the motors 230, 232 (106, 107) based on the signals from the rotation commanding unit 270, and fed the pulses to a PLL control circuit to correct the shift. In this manner, the synchronous rotation of the shafts is realized in a contactless manner.

In the section (3), the load to the motors is increased more than that in the section (2), so that the motor current to maintain the rotating speed at the set value is increased. The reason for the increase of the load is presumed to be the abnormality of bearings and the like, the contact of the rotors 104, 105 with the housing 101 due to the dimensional increase in the diametrical direction as a result of the thermal expansion prior to seizing, or the like increase of the mechanical load. Moreover, the reason for the electric increase of the motor current is supposed to be improper switching of motor drivers 250, 252, or shortcircuiting inside the motors, etc. When the current becomes a set current value $i_0$, the rotation commanding unit 270 makes a decision based on the data output from the relative position detecting unit 260 and the motor current detecting units 262, 264. For instance, when the motor current is increased to reach the set current value $i_0$ and the output of the relative position detecting unit 260 assumes a shift, the motor current to all the motors 230, 232 (106, 107) is stopped and the rotary shafts 220, 222 (102, 103) are decelerated and stopped while the contact between the gears 144, 154 is maintained. This state is shown in the section (4) in FIG. 5.

If the motor current is increased to reach the set value $i_0$, but the relative position detecting unit 260 detects no shift (this shows in a seizing condition.), the motor current to all of the motors 230, 232 (106, 107) is stopped to decelerate to stop the rotary shafts 220, 222 (102, 103) with keeping the contact between the gears 144, 154, which is represented in the section (4) in FIG. 5.

Figure 13:
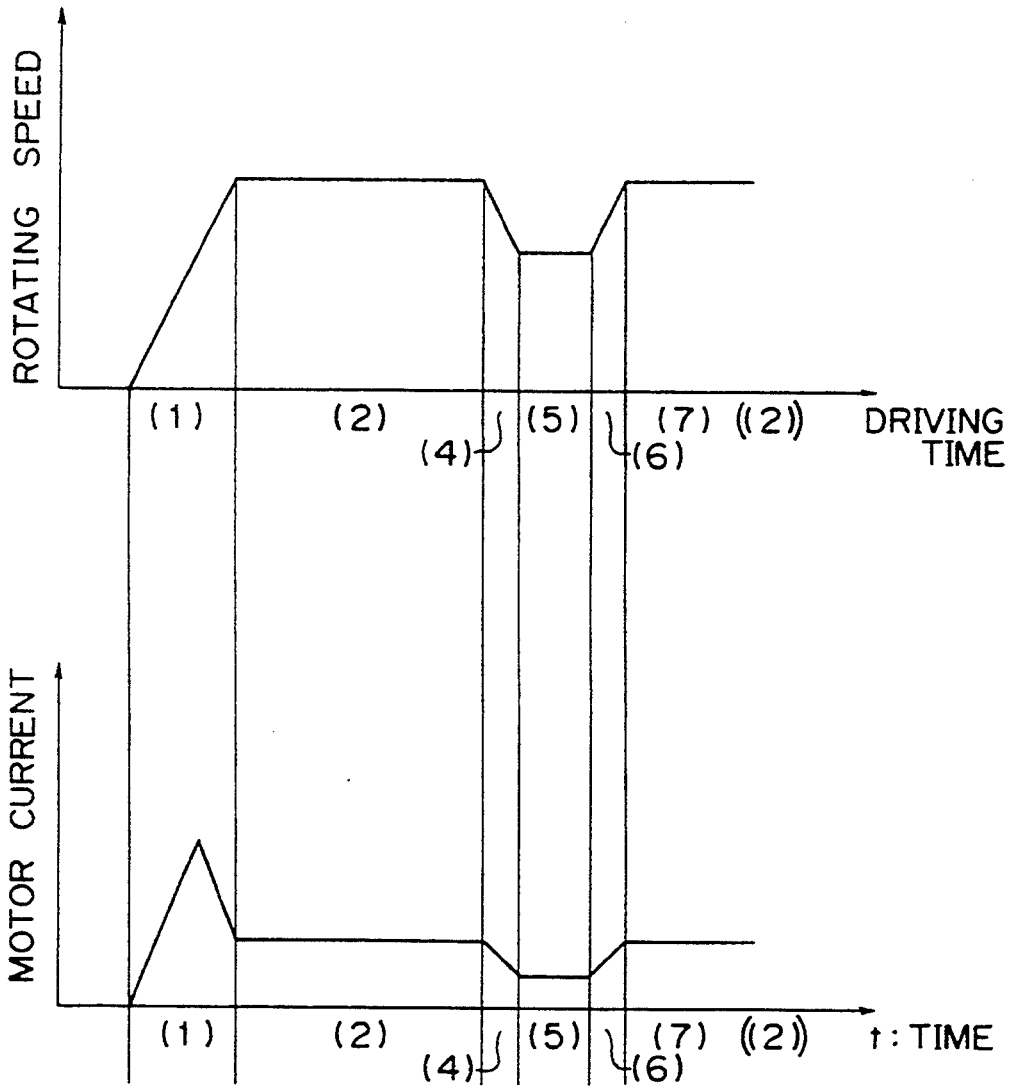
FIG. 13 is a characteristic curve diagram of the relationship between the driving time and the rotating speed of a rotary shaft, and the relationship between a motor current and the time in a positive displacement vacuum pump of a still another embodiment of the present invention.

Meanwhile, if the motor current is not increased and the output of the relative position detecting unit 260 indicates a shift of the synchronous rotation, it means that the control for the synchronous rotation is lost or the shift is gradually accumulated, without any mechanical or electric abnormality found, not alike the foregoing two examples. Therefore, as shown in the section (4) in FIG. 6, the motor current is gradually decreased while it is applied to one motor 230 or 232, thereby decelerating and stopping the rotary shafts 220, 222 (102, 103). At that time, only one rotor is driven for rotation and the other rotor is not driven, and thus the rotors rotate with the contact preventing gears 144 and 154 coming in contact with each other, resulting in eliminating looseness between the gears 144 and 154. In this case, the motor current may be reduced as it is being impressed to both motors 230, 232. During the decelerating process, produced through the control of the motor controlling units 254, 256 via the rotation command unit 270, when the shift of the synchronous rotation of the rotary shafts is corrected, as shown in FIG. 13, the rotary shafts 220, 222 (102, 103) are accelerated to a specified rotating frequency. In FIG. 13, the sections (1), (2), and (4) are similar to those of the above embodiment. In the section (5), the shift of the synchronous rotation of the rotary shafts 220, 222 (102, 103) is corrected during the decelerating process. In the section (6), the rotary shafts 220, 222 (102, 103) are accelerated. In the section (7), the vacuum pump is operated at the set rotating speed, alike the section (2).

As described hereinabove, in the present invention, the rotary shafts 220, 222 (102, 103) are driven by the respective independent motors 230, 232 (106, 107). Moreover, the outputs of the incremental encoders 241, 242 and absolute encoders 243, 244 are utilized as a rotation information signal to control the synchronous rotation by the relative position detecting unit 260, rotation commanding unit 270, and control circuits 254, 256, thus dispensing with many gears for the transmission of power. The apparatus becomes compact and maintenance-saving. Further, the rotation commanding unit 270 makes decision based on the outputs of the motor current detecting units 262, 264 and the relative position detecting unit 260 thereby to decelerate and stop the rotary shafts 220, 222 (102, 103). Accordingly, the rotary shafts 220, 222 (102, 103) are prevented from being damaged and broken through mechanical collision therebetween, and the motors 230, 232 (106, 107) are prevented from being burnt out.

In the case where the rotary shafts are decelerated and stopped with holding the contact between the gears 144, 154 by stopping the supply of current to the motors 230, 232 (106, 107), it becomes possible to decelerate and stop the rotary shafts quickly. As the motor current is stopped, the demagnetization of motors due to the burning thereof or the flow of current can be prevented.

When the rotary shafts 220, 222 (102, 103) are decelerated to stop by gradually decreasing the motor current while the current is continuously applied to at least one of the motors 230 (106) and 232 (107), only a small amount of load is impressed to the gears 144, 154, extending the life of the gears. Needless to say, the rotary shafts 220, 222 (102, 103) can be prevented from being mechanically damaged or broken.

Figure 7:
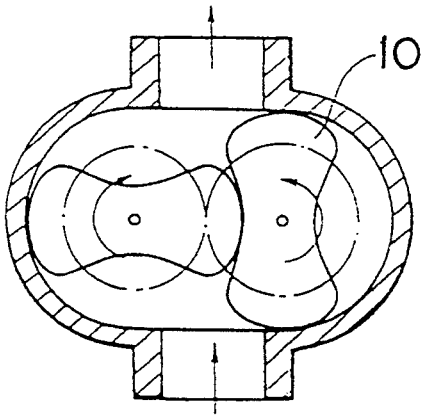
FIG. 7 schematically illustrates a rotor according to a modified embodiment of the present invention.
Figure 9A:
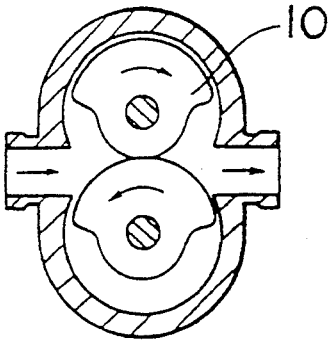
FIGS. 9A and 9B schematically illustrate rotors according to still further modifications of the present invention.
Figure 8:
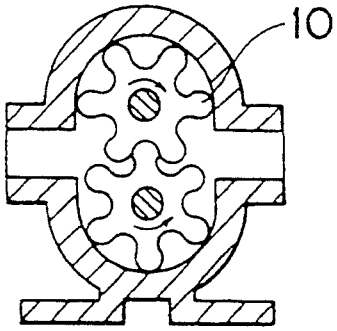
FIG. 8 schematically illustrates a rotor according to a further modified embodiment of the present invention.
Figure 9B:
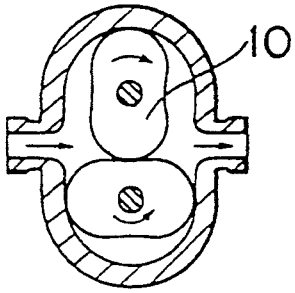
Figure 11:
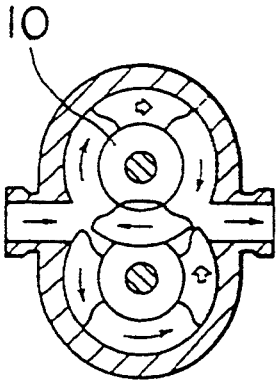
FIG. 11 is a schematic diagram of a rotor according to a yet further modification of the present invention.
Figure 10:
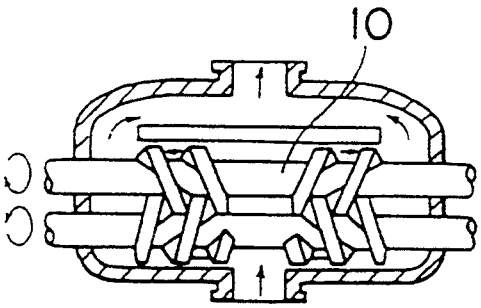
FIG. 10 is a schematic diagram of a rotor according to a yet modified embodiment of the present invention.

Although the foregoing embodiment is related to the non-circular rotors in the shape of screws, the rotors may be of different shape, e.g., the Roots type of FIG. 7, the gear type of FIG. 8, the single lobe or double lobe type of FIG. 9(A) or 9(B), the screw type of FIG. 10, or the outer circumferential piston type of FIG. 11.

According to the present invention, since the rotary shafts are driven independently by the corresponding motors and controlled by a non-contacting rotation synchronizing means, many gears for the purpose of the synchronous rotation and the transmission of power are not necessitated. Therefore, a lubricating oil for the gears is not necessary. The apparatus becomes able to rotate at high speeds and compact in size, and the maintenance work is saved.

When the shift of the synchronous rotation of a plurality of rotary shafts during the rotation is detected by the motor current detecting unit and/or the relative position detecting unit, and decided by the rotation commanding unit, the rotary shafts are decelerated and stopped, and accordingly prevented from being damaged or broken through the mechanical collision therebetween.

If the sudden shift of the synchronous rotation of a plurality of rotary shafts is given rise to as a result of the damage of bearings, the contact between the rotors and housing, or the change of the load to the rotary shafts, etc., the current to the motors is stopped and the rotary shafts are decelerated or stopped while maintaining the contact with the gears. Accordingly, the rotary shafts can be prevented from being greatly damaged or broken, and the motors can be prevented from being burnt or demagnetized.

If the shift is rather very small, the current is supplied to at least one of the motors so as to be gradually reduced, whereby the other rotary shaft presses to decelerate the rotary shaft without the supply of current via the contacting gears. Accordingly, the rotary shafts can be prevented from being damaged or broken.

When a plurality of the non-circular rotors are formed in the shape of screws, the flow of fluid becomes approximately continuous, with the internal leak reduced. Moreover, a large internal space of the rotors is secured to be utilized as a space to accommodate the bearings, motors and the like. In consequence, the apparatus becomes compact in structure.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A fluid rotating apparatus provided with a plurality of rotors accommodated in a housing, a plurality of rotary shafts connected to the rotors, bearings for rotatably supporting the plurality of rotary shafts, a fluid suction port and a fluid discharge port formed in the housing, a positive displacement pump section formed of combination of the housing and the plurality of rotors, and a plurality of gears connected with the rotary shafts having a backlash set smaller than a backlash between the plurality of rotors, the fluid rotating apparatus characterized by further comprising:

motors for independently driving the plurality of rotary shafts;

a rotation detecting means for detecting one of a rotating angle and speed of rotation of the motors;

a motor controlling unit for controlling the motors to synchronously rotate;

a motor current detecting unit for detecting a current running in the motors;

a relative position detecting unit for detecting a relative position of the plurality of rotary shafts; and a rotation commanding unit, to which outputs from the motor current detecting unit and the relative position detecting unit are inputted, for deciding whether or not a shift amount of the synchronous rotation of the plurality of rotary shafts is larger than a specified value based on the outputs of the motor current detecting unit and/or the relative position detecting unit, and outputting to the motor controlling unit a signal to decelerate one of the plurality of rotary shafts when the rotation command unit decides that the shift amount of the synchronous rotation of the plurality of rotary shafts is larger than the specified value.

2. The fluid rotating apparatus as claimed in claim 1, wherein the rotation command unit outputs such a signal to the motor controlling unit that a current to all of the motors is stopped to the plurality of rotary shafts while the contact of the plurality of gears is maintained.

3. The fluid rotating apparatus as claimed in claim 1, wherein the plurality of rotors are formed in the shape of screws.

4. The fluid rotating apparatus as claimed in claim 1, wherein the specified value for comparing with the shift amount of the synchronous rotation of the plurality of rotary shafts is set to be less than the backlash between the gears.

5. The fluid rotating apparatus as claimed in claim 1, wherein the rotation commanding unit outputs to the motor controlling unit a signal to decelerate and then stop one of the plurality of rotary shafts.

6. The fluid rotating apparatus as claimed in claim 1, wherein the rotation command unit outputs such a signal to the motor controlling unit that the plurality of rotary shafts are decelerated while a current is continuously supplied to one of the motors and a current is not supplied to the other of the motors.

7. The fluid rotating apparatus as claimed in claim 6, wherein after the plurality of rotary shafts are decelerated while a current is continuously supplied to one of the motors and a current is not supplied to the other of the motors, the rotation command unit outputs such a signal to the motor controlling unit that the plurality of rotary shafts rotate synchronously again.

8. A method for controlling rotation of rotors in a fluid rotating apparatus provided with a plurality of rotors accommodated in a housing, a plurality of rotary shafts connected to the rotors, bearings for rotatably supporting the plurality of rotary shafts, a fluid suction port and a fluid discharge port formed in the housing, a positive displacement pump section formed of a combination of the housing and the plurality of rotors, and a plurality of gears connected with the rotary shafts having a backlash set smaller than a backlash between the plurality of rotors, the fluid rotating apparatus further including motors for independently driving the plurality of rotary shafts, a rotation detecting means for detecting one of a rotating angle and speed of rotation of the motors, a motor controlling unit for controlling the motors to synchronously rotate, a motor current detecting unit for detecting a current running in the motors, a relative position detecting unit for detecting a relative position of the plurality of rotary shafts and a rotation commanding unit to which outputs from the motor current detecting unit and the relative position detecting unit are inputted, the method characterized by comprising the steps of:

detecting a shift amount of the synchronous rotation of the plurality of rotary shafts based on the outputs of the motor current detecting unit and/or the relative position detecting unit;

deciding by the rotation command unit whether or not the shift amount of the synchronous rotation of the plurality of rotary shafts is larger than a specified value; and decelerating one of the plurality of rotary shafts when the rotation command unit decides that the shift amount of the synchronous rotation of the plurality of rotary shafts is larger than the specified value.

9. The method as claimed in claim 8, wherein in the decelerating step, a current to all of the motors is stopped to thereby decelerate the plurality of rotary shafts while the contact of the plurality of gears is maintained.

10. The method as claimed in claim 8, wherein in the deciding step, the specified value for comparing with the shift amount of the synchronous rotation of the plurality of rotary shafts is set to be less than the backlash between the gears.

11. The method as claimed in claim 8, wherein in the decelerating step, the one of the plurality of rotary shafts stops finally.

12. The method as claimed in claim 8, wherein in the decelerating step, the plurality of rotary shafts are decelerated while a current is continuously supplied to one of the motors and a current is not supplied to the other of the motors.

13. The method as claimed in claim 12, further comprising, after the decelerating step, a step of synchronously rotating the plurality of rotary shafts again.

* * * * *